United States Patent [19]

Schoolden

[11] 3,937,519

[45] Feb. 10, 1976

[54] MOBILE CHAIR FOR PARAPLEGICS

[76] Inventor: Raymond Schoolden, 11043 NW. Flagler Terrace, Miami, Fla. 33172

[22] Filed: Mar. 25, 1974

[21] Appl. No.: 454,615

[52] U.S. Cl. ..... 297/347; 297/DIG. 10; 297/352; 297/DIG. 4; 180/77 R; 188/2 F; 5/81 R; 280/211; 280/242 WC

[51] Int. Cl.[2] ..... A47C 3/20

[58] Field of Search... 280/211, 220, 242 R, 242 WC; 188/2 F, 16, 29, 354; 297/DIG. 4, DIG. 10, 5, 347, DIG. 9; 180/77 R; 224/29; 272/70.3; 5/81

[56] References Cited

UNITED STATES PATENTS

| | | | |
|---|---|---|---|
| 267,328 | 11/1882 | Cooper | 188/16 |
| 1,181,796 | 5/1916 | Pendleton | 297/DIG. 9 |
| 2,129,260 | 9/1938 | Bowser | 297/DIG. 4 |
| 2,762,422 | 9/1956 | Stratton | 297/DIG. 4 |
| 2,776,701 | 1/1957 | Denis | 297/DIG. 4 |
| 2,859,837 | 11/1958 | Mize | 188/2 F |
| 2,914,110 | 11/1959 | Schulte | 297/DIG. 4 |
| 3,107,105 | 10/1963 | Heriford | 280/211 |
| 3,272,530 | 9/1966 | Klassen | 297/5 X |
| 3,301,574 | 1/1967 | Good | 297/DIG. 4 |
| 3,488,088 | 1/1970 | Goldberg | 297/5 |
| 3,869,171 | 3/1975 | Wilson | 297/DIG. 4 X |
| D112,691 | 12/1938 | Comper | 297/5 X |

FOREIGN PATENTS OR APPLICATIONS

| | | | |
|---|---|---|---|
| 1,284,564 | 12/1968 | Germany | 297/DIG. 4 |

*Primary Examiner*—M. H. Wood, Jr.
*Assistant Examiner*—John P. Silverstrim
*Attorney, Agent, or Firm*—Oltman and Flynn

[57] ABSTRACT

The present wheel chair has a hydraulic jack for raising and lowering a seat. The frame of the chair has spaced opposite sides and a jack-supporting horizontal platform at the bottom. At the back, the frame of the chair is open above this platform so that the user enters and leaves the chair (getting on and off the seat) from the back.

2 Claims, 4 Drawing Figures

MOBILE CHAIR FOR PARAPLEGICS

This invention relates to a wheel chair which is open at the back to facilitate the ingress and egress of a handicapped or disabled person. The chair has a horizontal seat which can be raised and lowered vertically under the manual control of the user. The seat is operated by a hydraulic jack mounted on a platform below the seat.

A principal object of this invention is to provide a novel and improved wheel chair which makes it easier for a disabled person to get in and out of the chair, such as from a bed, a bathtub, shower, or toilet seat, or a conventional chair.

These and other objects and advantages in one embodiment of the invention are described and shown in the following specification and drawings, in which.

Figure 1:
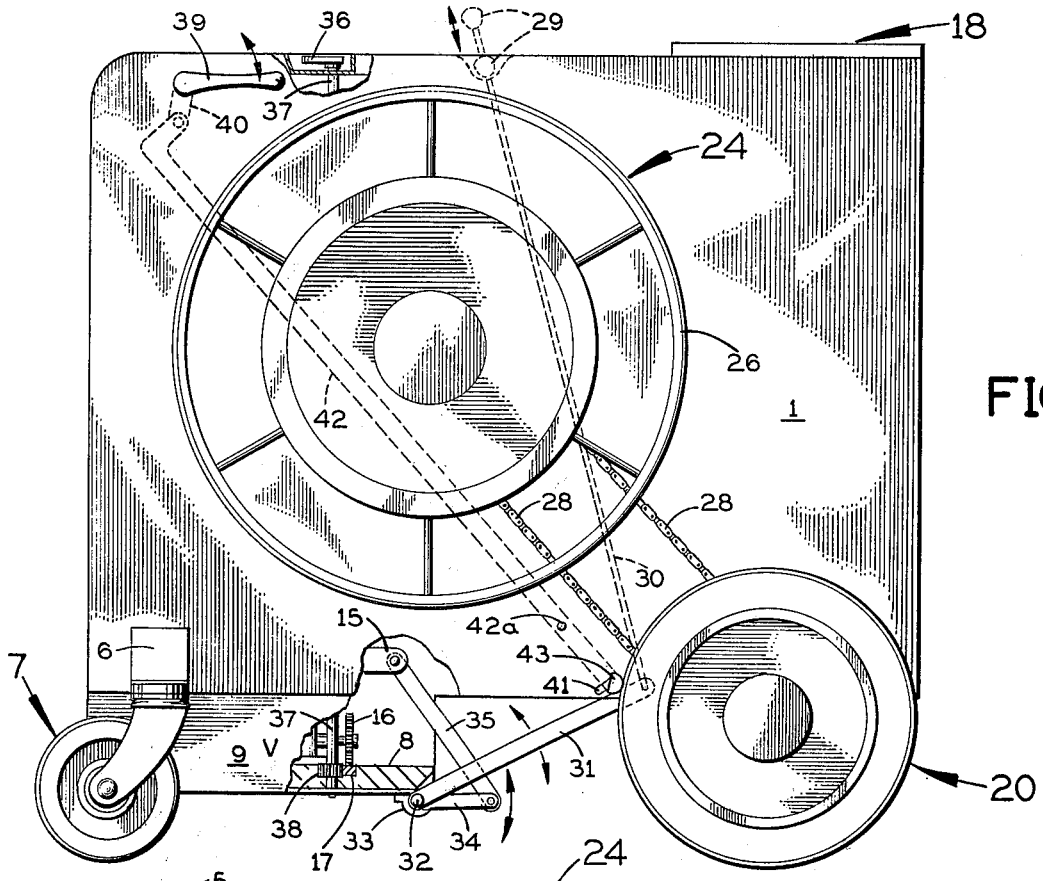
FIG. 1 is a right side elevation of the chair in greatly reduced scale.

Referring to FIGS. 1–4, the frame of the mobile chair is generally rectangular having parallel spaced wood or sheet metal side members 1 and 2 with inward extending sides 3 and 4 integral therewith and outward extending left and right extensions 5 and 6 for securing a pair of like caster wheel assemblies 7 thereto. A horizontal rear platform 8 is secured to the side members 1 and 2 on right angle flanges 9 and 10. A horizontal platform footrest 11 having a concave inner central contour is secured to the front portion of sides 3 and 4 spanning opposite side members 1 and 2.

Figure 2:
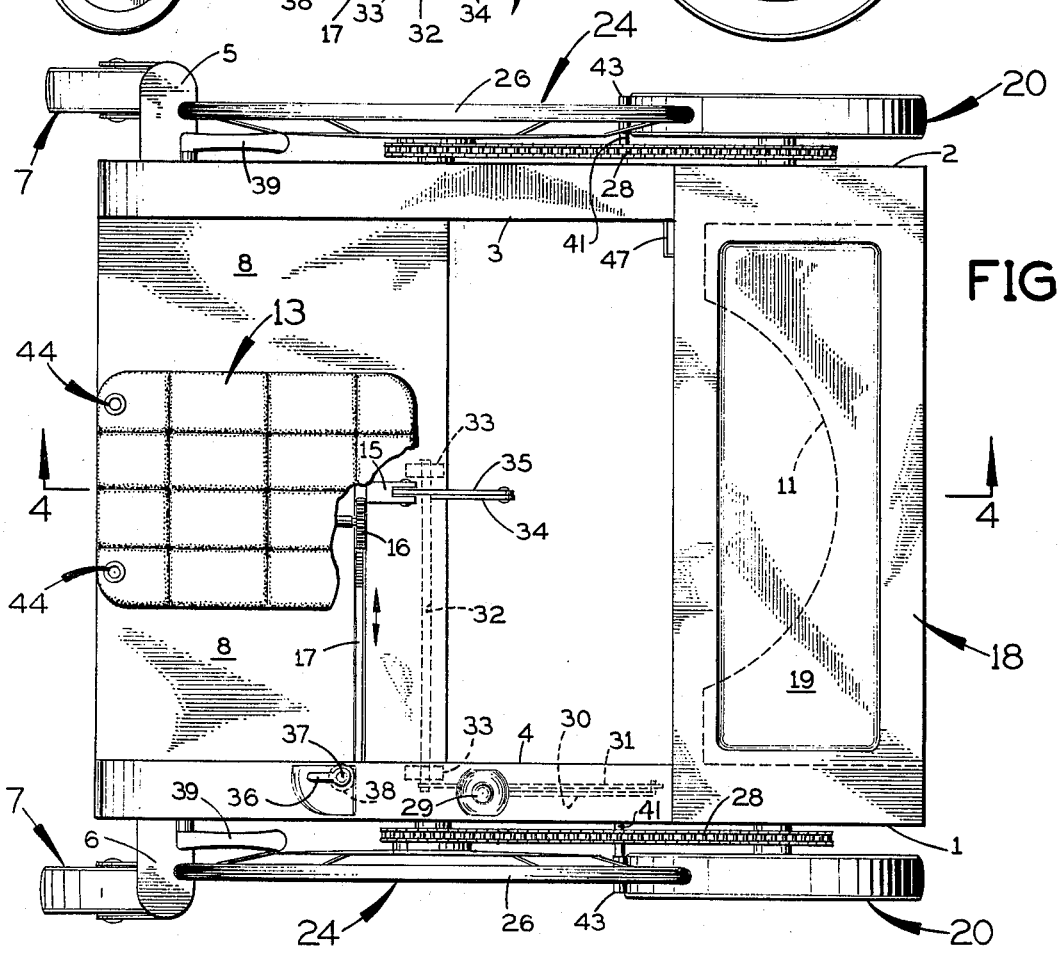
FIG. 2 is a top plan view of the chair shown in FIG. 1.
Figure 3:
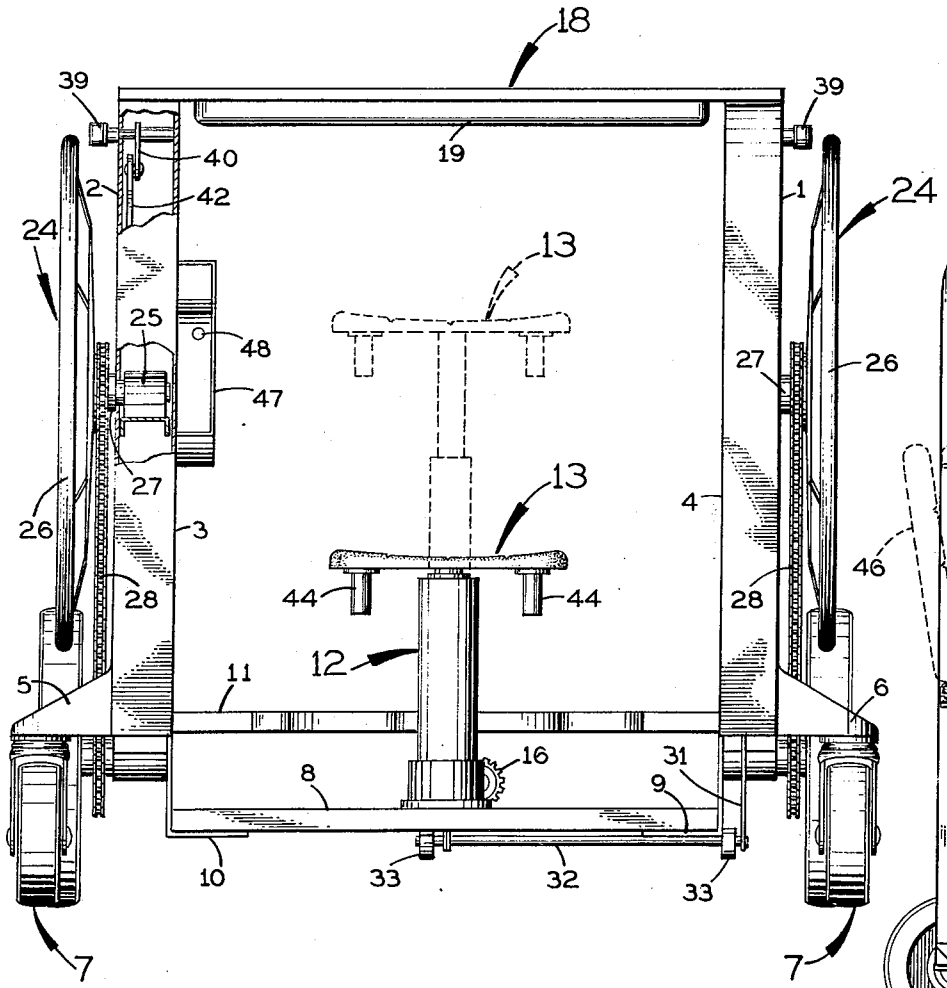
FIG. 3 is a rear end elevation of the chair shown in FIG. 1.

Referring to FIGS. 2 and 3, a hydraulic jack assembly 12 of known design is secured to platform 8 by well known means and the plunger of the hydraulic jack is adapted to raise a padded seat assembly 13 vertically from a lowermost idle position to an adjustable height, illustrated by dotted lines in FIGS. 3 and 4, by the reciprocation of an associated hydraulic pump 14 which is operated by piston 15, to be hereinafter described. The jack assembly has a release valve V of known design, which is operable by a gear 16 to permit the slow return of the seat 13 down to normal rest position. Gear 16 is operated by a rack gear 17 slidably secured on platform 8 and controlled by means to be hereinafter described. The seat 13 remains horizontal while being raised and lowered vertically. A table assembly 18 is secured to opposite upper horizontal sides 3 and 4, as shown in FIGS. 2, 3, and 4, which includes a recessed utility tray 19.

Each of a pair of front traction wheel assemblies 20-20 has a chain sprocket 21 of predetermined diameter and pitch secured on the inside of each front wheel coaxial therewith with the wheels journalled for rotation about an axle 22 which is supported by a pair of pillow blocks 23 secured to the horizontal under side of each side 3 and 4, respectively. A pair of handoperated wheel assemblies 24 having six angular offset spokes are secured for manual rotation in bearings 25 on side members 1 and 2 in predetermined spaced relation to the outside surface of side members 1 and 2 and in coaxial relation and positioned for convenient grasp by the hands of the user, as illustrated in FIG. 1. Each hand wheel has a circular rim 26 of substantially circular cross section and may include an elastomer covering for secure hand gripping. Each hand wheel has a sprocket 27 of predetermined diameter and pitch secured coaxial therewith on the inside surface of each wheel. An endless chain 28, preferably the roller type, is engaged with mating sprockets 21 and 27 on each side member of the chair which provides the means for rotation of the hand wheels to independently rotate each front wheel 20, as desired by the user.

It is understood that the ratio of sprockets on the hand wheel and the traction wheel may be varied to obtain a desired ratio of torque to suit the capabilities of the user.

Figure 4:
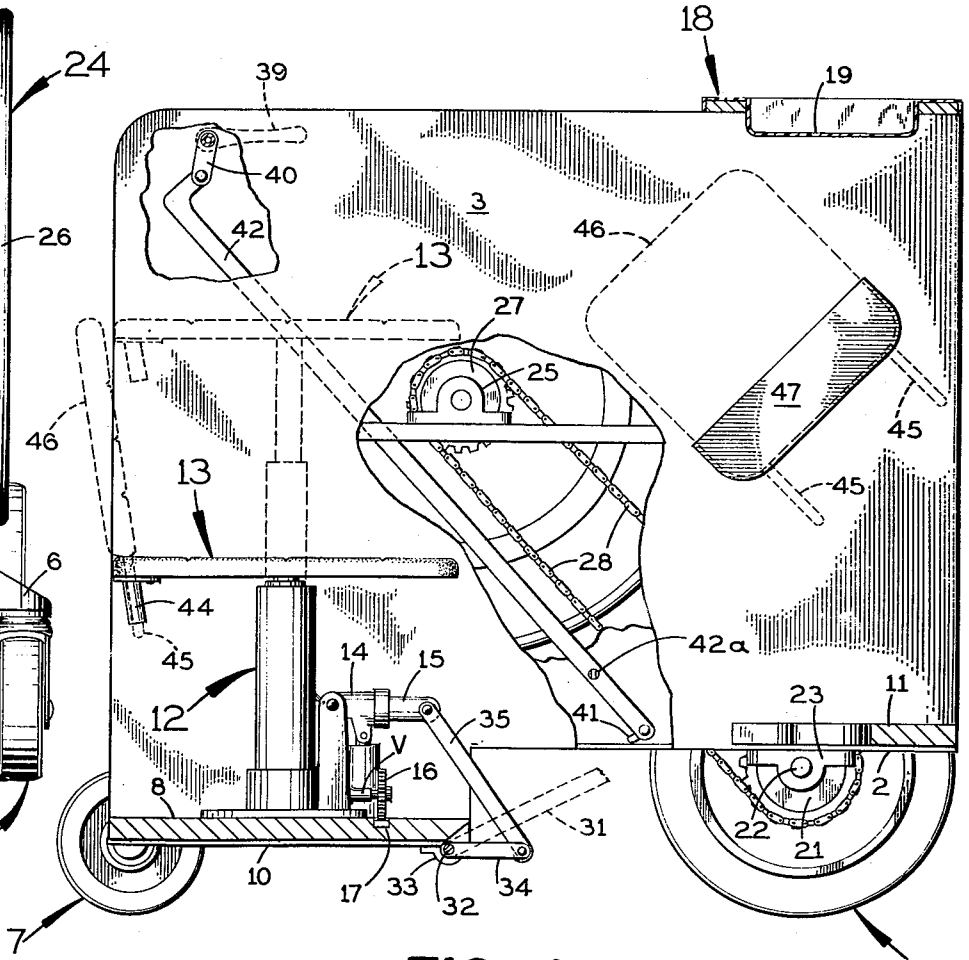
FIG. 4 is a cross sectional side elevation of the chair, taken through section line 4—4, FIG. 2.

Referring to FIGS. 1, 2, and 4, a first handle or control knob 29 is secured in a depressed cavity in the uppermost side 4 which is attached to a first elongated rod 30 adapted for the manual reciprocation of a central lever 31 secured to a transverse shaft 32 which is journalled in a bearing 33 which will oscillate a second lever 34 which is connected to a link 35 for operating the pump piston 15, better shown in FIG. 4. It is therefore apparent that the reciprocation of knob 29 will operate jack assembly 12 and raise seat assembly 13 accordingly.

Referring to FIG. 2, a second handle 36 on the upper side of side 4 is connected to the upper end of a vertical second, elongated, rod-like member or shaft 37 which shaft is journalled for partial rotation and carries a piston 38 on its lower end for reciprocating the rack gear 17 a predetermined distance for operating the valve V in the hydraulic jack assembly for permitting the seat to lower from an upward position.

Referring to FIGS. 1, 3, and 4, an independent brake lever 39 is journalled for rotation on each side of the frame near the top edge for convenient operation by each hand of the user. Each brake lever has an internal arm 40 which is pivotally connected by a long link 42 to a short, horizontal, laterally outwardly extending arm 41, which is located directly behind the lower end of link 42, as shown in FIG. 1. This short arm 41 carries a cylindrical brake member 43, which is immediately behind the corresponding front wheel and is frictionally engageable with this wheel to lock it against rotation. The long link 42 is pivoted at **42*a* (FIG. 1) to the corresponding side member 1 or 2** of the chair frame, at a location a short distance above the lower end of this link.

When the handle 39 is pivoted counterclockwise from the position shown in FIG. 1 to a raised position, the linkage arrangement just described retracts the brake member 43 to a positioned spaced behind the corresponding front wheel 20, so that this wheel is free to turn. When the handle 39 is pivoted down from this brake-retracting position clockwise to the position shown in FIG. 1, the just-described linkage forces the brake member 43 forward into braking engagement with the back of the corresponding front wheel. Thus it is apparent that when each lever 39 is in its upper off position the chair is free to be propelled in a forward or reverse direction and steered at the option of the user. When each lever is moved in a down position the opposite hand wheel will provide for a close turn of the chair and when both hand levers 39 are in the down position the traction wheels will be locked against movement.

It is to be noted that the seat is equipped with a pair of sockets 44 for slidably receiving a pair of parallel pins 45 which are positioned in the outside lower edge of a removable backrest assembly 46.

FIGS. 3 and 4 illustrate a convenient placement for a socket 47 with holes 48 for pins 45 for retaining a removable backrest assembly 46 when not in use by convenient transfer from the seat assembly 13 to the socket 47, as illustrated in dotted lines in FIG. 4.

In operation and under the assumption that the rear side of the chair is moved into rear transfer position with respect to a bed or chair with the user in a sitting position and the brake levers 39 both moved downward to lock the chair in immobile position, then by adjustment of the seat in the chair by the operation of the knob 29 or lever 36 the user may be moved feet first on opposite sides of the seat until he is seated thereon with his feet on a footrest 11. He may then release the brakes by raising both levers 39 to their off position and then manually rotate the drive wheel assemblies 24 in a forward direction which wheels also may be used for accurately steering the chair while in motion. Having reached a desired destination, the brake lever 39 may be moved downward which will lock the chair against immobility. It is now apparent that the user may adjust the seat for the most comfortable position and the table and tray may be used for whatever purpose desired.

It will be evident that the present wheel chair facilitates the entry of the user onto the seat, or the user's removal from the seat, in a relatively comfortable and advantageous manner because of the fact that the frame of this chair is open at the back end.

It is to be understood that certain modifications in construction are intended to come within the scope and teachings of the above construction.

Having described my invention, I claim:

1. In a wheel chair having:

a chair frame with spaced, opposite sides; means at the front of said frame extending between and rigidly interconnecting said sides;

and front and back wheels operatively connected to the frame at each side to provide a rolling support for the frame;

a rigid horizontal platform extending between said sides at the bottom of the frame;

a seat jack mounted on said platform and extending upward therefrom between said sides of the frame, said jack having an operating member movable between a retracted, lowered position and an extended, raised position; a horizontal seat operatively connected to said operating member of the jack to be vertically raised and lowered while being maintained horizontal;

said chair frame being open at the back between said sides above said platform for the entry and withdrawal of the user to and from the seat at the back of the chair frame;

and mechanical actuator means for the jack operatively coupled at the lower end thereof to said operating member of the jack to selectively control the latter's operation for raising and lowering the seat, said actuator means extending up from said jack and terminating at the upper end thereof in handle means located for operation by the occupant of said seat;

the improvement wherein said mechanical actuator means comprises:

a first elongated rod-like member operable in one direction for operating said jack to raise the seat, a first handle on the upper end of said first rod-like member;

and a second elongated rod-like member operable in one direction for actuating said jack to lower the seat, and a second handle on the upper end of said second rod-like member.

2. A wheel chair according to claim 1, wherein said jack is a hydraulic jack.

* * * * *